US012377306B2

(12) United States Patent
Guo

(10) Patent No.: US 12,377,306 B2
(45) Date of Patent: Aug. 5, 2025

(54) DUMBBELL HANDLE, DUMBBELL AND DUMBBELL BASE

(71) Applicant: Hao's Fitness Equipment (Shanghai) Co., Ltd. TRADING LTD., Shanghai (CN)

(72) Inventor: Liqiang Guo, Zhejiang (CN)

(73) Assignee: HAO'S FITNESS EQUIPMENT (SHANGHAI) CO., LTD. TRADING LTD., Shanghai (CN)

( * ) Notice: Subject to any disclaimer, the term of this patent is extended or adjusted under 35 U.S.C. 154(b) by 0 days.

(21) Appl. No.: 18/688,699

(22) PCT Filed: Sep. 8, 2021

(86) PCT No.: PCT/CN2021/117190
§ 371 (c)(1),
(2) Date: Sep. 10, 2024

(87) PCT Pub. No.: WO2023/272940
PCT Pub. Date: Jan. 5, 2023

(65) Prior Publication Data

US 2025/0205542 A1 Jun. 26, 2025

(30) Foreign Application Priority Data

Jul. 1, 2021 (CN) ..... 202121503854.3

(51) Int. Cl.
*A63B 21/075* (2006.01)
*A63B 21/072* (2006.01)
(Continued)

(52) U.S. Cl.
CPC ..... *A63B 21/075* (2013.01); *A63B 21/0726* (2013.01); *A63B 21/0728* (2013.01); *A63B 24/0087* (2013.01); *A63B 71/0036* (2013.01)

(58) Field of Classification Search
CPC ..... A63B 21/075; A63B 21/0726; A63B 21/0728
See application file for complete search history.

(56) References Cited

U.S. PATENT DOCUMENTS

2012/0309597 A1 12/2012 Liu
2019/0168059 A1* 6/2019 Svenberg ..... A63B 21/0726
(Continued)

FOREIGN PATENT DOCUMENTS

CA 3111055 A1 * 8/2022 ..... A63B 21/00065
CN 201558453 U * 8/2010
(Continued)

*Primary Examiner* — Joshua T Kennedy
(74) *Attorney, Agent, or Firm* — Ying-Ting Chen

(57) ABSTRACT

A dumbbell handle, a dumbbell and a dumbbell base, wherein the dumbbell handle comprises: a handle body; a gear rotation assembly, wherein a planetary gear mechanism is sleeved on one end of a gear shaft, another end of the gear shaft is nested in a first cavity, and an inner wall of each of two ends of a second cavity of the gear shaft is provided with a first protruding block; a telescopic shaft, wherein a thread groove that matches the first protruding block is provided in a side wall of the telescopic shaft; and a cam mechanism, wherein a driving wheel engages with a driven wheel, an elastic member is arranged on the side of the driven wheel away from the driving wheel, the driving wheel is sleeved on an end portion of the gear shaft, and the driving wheel is driven by the gear shaft to rotate.

9 Claims, 5 Drawing Sheets

(51) Int. Cl.
*A63B 24/00* (2006.01)
*A63B 71/00* (2006.01)

(56) References Cited

U.S. PATENT DOCUMENTS

| | | | | |
|---|---|---|---|---|
| 2022/0152443 | A1* | 5/2022 | Casagrande | A63B 21/0728 |
| 2023/0031956 | A1* | 2/2023 | Luo | A63B 21/0726 |
| 2023/0052772 | A1* | 2/2023 | Wang | A63B 71/0036 |
| 2024/0198166 | A1* | 6/2024 | Wang | A63B 21/0726 |

FOREIGN PATENT DOCUMENTS

| | | | | | |
|---|---|---|---|---|---|
| CN | 106693278 | A | | 5/2017 | |
| CN | 207640883 | U | | 7/2018 | |
| CN | 202020827619.0 | A1 | | 5/2020 | |
| CN | 111450475 | A | | 7/2020 | |
| CN | 212282678 | U | * | 1/2021 | A63B 21/075 |
| CN | 213193204 | U | | 5/2021 | |
| CN | 118949345 | A | * | 11/2024 | |
| CN | 221964416 | U | * | 11/2024 | |

* cited by examiner

DUMBBELL HANDLE, DUMBBELL AND DUMBBELL BASE

TECHNICAL FIELD

The present invention relates to the technical field of exercise apparatuses, especially a dumbbell handle, a dumbbell and a dumbbell base.

BACKGROUND TECHNOLOGY

A dumbbell is a piece of commonly used fitness equipment, and currently dumbbells commercial available are divided into fixed-weight dumbbells and adjustable dumbbells. Among them, for the adjustable dumbbells, dumbbells of different weights are made by adjusting a number of weight plates. Usually, for the adjustable dumbbells, a plurality of weight options are provided on the dumbbells, during use, by stretching or reducing the dumbbell handle to increase or remove weight plates, the dumbbells can have different weights and can be used conveniently for exercise in different stages. However, the number of adjustable options for the dumbbells are usually dependent on the weight plates that can be installed in either sides of the dumbbells, and for each option the weight is a sum of the weight of the two weight plates and the dumbbell handle, and by such configuration, the adjustable dumbbells have few adjustable options, and during use, frequently, as the weight differences between the options are big than what the user can bear for each increase, especially for women who are weak in strength, the dumbbell cannot satisfy the requirements of users satisfactorily.

SUMMARY OF INVENTION

I. The Technical Problem to be Solved

In view of the technical problem that the adjustable dumbbells have few adjustable options, and the weight adjusted by each option is too big, the present invention provides a dumbbell, a dumbbell handle and a dumbbell base, and with which the adjustable options of the dumbbell can be increased efficiently, and the problem that the weight increased or reduced by each adjustment is too big can be overcome.

II. The Technical Solutions

To address the foregoing problems, the technical solutions that the present invention provides are:

A dumbbell handle, comprising: a handle body, wherein a first cavity is provided in the handle body; a gear rotation assembly, wherein the gear rotation assembly comprises a planetary gear mechanism and a gear shaft, the planetary gear mechanism is sleeved over an end of the gear shaft, another end of the gear shaft is sleeved in the first cavity of the handle body; the gear shaft is provided with a second cavity, at least one first protruding block is respectively provided on both ends of the second cavity of the gear shaft; a extendable shaft, wherein the extendable shaft is sleeved in the second cavity in the gear shaft, at least one threaded slot engaging with the at least one first protruding block is provided in the extendable shaft, by rotating the planetary gear mechanism the gear shaft is driven to rotate and the extendable shaft is driven to move axially in the second cavity of the gear shaft; a cam disc mechanism, wherein the cam disc mechanism comprises a drive disc and a driven disc, the drive disc and the driven disc are engaged by sliding, a flexible piece is provided at a side of the driven disc on an opposing side from the drive disc, the drive disc is sleeved over an end of the gear shaft, the drive disc is driven to rotate by the gear shaft and drives the driven disc to make reciprocating linear movement.

In the present invention, an attachment of the dumbbell is half in weight to a weight plate, the driven disc is configured to engage with the attachment, the planetary gear mechanism comprises a ring gear, a sun gear and three planet gears, and is applied in the dumbbell handle. During use, by rotating the planetary gear mechanism, the gear shaft is driven to rotate, due to the at least one first protruding block provided respectively at both ends of the second cavity of the gear shaft and the threaded slots provided in the extendable shaft for engaging with the at least one first protruding block, when the gear shaft rotates, the extendable shaft is driven to make axial movement in the second cavity of the gear shaft, that is, stretching and retraction of the extendable shaft in the second cavity; as the drive disc is sleeved over an end of the gear shaft, and a flexible piece is provided at a side of the driven disc on the opposing side from the drive disc is driven to rotate by rotation of the gear shaft, so that the driven disc is driven to make reciprocating linear movement along an axial direction of the gear shaft, so as to realize connection and separation of the driven disc and the attachment of the dumbbell. For the foregoing dumbbell handle, by using the planetary gear mechanism (comprising a ring gear, a sun gear and three planet gears), and taking use of the multiple relationship between the number of teeth of the ring gear and the number of teeth of the planet gears, the extendable shaft in the dumbbell handle can be adjusted by a smaller thread pitch, so that the extendable shaft can be accurately and quickly extended and retracted, the quick adjustment of the weight plates is made possible, that is, the adjustment of the weight options of the dumbbell; in the meanwhile, by the engagement between the cam disc structure and the gear shaft and the gear shaft and the extendable shaft, the extendable shaft can be extended or retracted in the dumbbell handle (adjusting the weight options of the dumbbell), engagement and separation between the driven disc and the attachment of the dumbbell can be realized, so that assembly and disconnection of the attachment of the dumbbell can be done, compared with conventional adjustable dumbbell, by the assembly and detachment of the attachment of the dumbbell, the adjustable options are increased, and the problem that as the adjustable weight between each of the options is too big and goes beyond the weight that users can bear to increase and exercise effects are affected, especially for women who are weak in strength has been overcome.

Optionally, the threaded slots comprise alternately connected flat threaded slots and diagonal threaded slots, and a thread pitch of the flat threaded slots is smaller than or equals a thread pitch of the diagonal threaded slots.

Optionally, the drive disc is provided with a hollow pillar that is sleeved over the end of the gear shaft, an end of the hollow pillar is provided with a ring boss, first crests and first troughs are provided intermittently and circumferentially along the ring boss, the driven disc is provided with a second hollow pillar, and the second hollow pillar is sleeved over the first hollow pillar, an attachment supporting piece is provided outside the second hollow pillar, second crests and second troughs are provided intermittently and circumferentially on an end of the second hollow pillar close to the ring boss, the first crests and the second troughs are provided, and the first troughs and the second crests are provided.

Optionally, the flexible piece is provided beside the attachment supporting piece.

Optionally, at least one first groove is provided in the gear shaft, a position of the at least one first groove is provided corresponding to the at least one first protruding block, and at least one first bulge meshing with the at least one first groove is corresponding provided on the drive disc.

Optionally, the present invention further comprises at least one first flange and at least one second flange, both ends of the dumbbell handle are provided with the at least one first flange, the at least one first flange at an end of the handle body is connected rotatably with the planetary gear mechanism; the planetary gear mechanism comprises a ring gear, a sun gear and three planet gears, the ring gear and the sun gear engage with the planet gears; the cam disc mechanism is provided on the second flange, the second flange engages with the ring gear by clearance fit, and the at least one first flanges, the planetary gear mechanism and the at least one second flange are fixed by threaded rods.

Optionally, the present invention further comprises a connection pin assembly, wherein a connection groove is provided along an edge of the at least one second flange on an opposing side from the gear mechanism, the connection pin assembly is slidably provided in the connection groove, so as to connect the ring gear and the extendable shaft.

In the meanwhile, the present invention further provides a dumbbell, wherein the dumbbell comprises the dumbbell handle, attachments of the dumbbell and weight plates are evenly provided at both ends of the dumbbell handle, and the attachments of the dumbbell are provided in between first weight plates close to the dumbbell handle and the cam disc mechanism.

Optionally, supporting grooves for connection and engagement with the at least one driven disc are provided in the attachments of the dumbbell.

Furthermore, the present invention provides a dumbbell base, and the dumbbell base is configured to place the dumbbell, a supporting structure is provided on the dumbbell base and the supporting structure engages with the dumbbell base for adjusting a length of the dumbbell handle.

III. Beneficial Effects

With the technical solutions provided in the present invention, compared with the prior art, the present invention has the following beneficial effects:

(1) For the dumbbell handle provided in embodiments of the present invention, by using the planetary gear mechanism (comprising a ring gear, a sun gear and three planet gears), and making use of the multiple relationship between the number of teeth of the ring gear and the number of teeth of the sun gear, the extendable shaft in the dumbbell handle can be adjusted by a smaller thread pitch, quick extension and retraction of the extendable shaft in the dumbbell handle can be done accurately, so as to realize quick adjustment of the number of weight plates, that is, adjustment of the weight options of the dumbbell; in the meanwhile, by the engagement relationships between the cam disc mechanism, the flexible pieces and the gear shaft and the gear shaft and the extendable shaft, while extending or retracting the extendable shaft in the dumbbell handle (for adjusting the weight options of the dumbbell), connection and separation of the driven disc and the attachments of the dumbbell can be done, so as to connect or disconnect the attachments of the dumbbell, compared with conventional adjustable dumbbells, by assembly and detachment of the attachments of the dumbbell, the number of adjustable weight options is increased, and the problem that due to the fact that the weight between each of the adjustable weight options is big, and goes beyond the weight that users can bear for each increase, exercise effects are affected, especially for women who are weak in strength can be overcome.

(2) For the dumbbell handle proposed in the present invention, by providing the threaded slots comprising alternately connected flat threaded slots and diagonal threaded slots, and configuring the thread pitch of the flat threaded slots to be less than or equal the thread pitch of the diagonal threaded slots; by controlling the first protruding block on the gear shaft to engage alternately with the flat threaded slots and the diagonal threaded slots in the extendable shaft, quick assembly and disconnection of the attachments of the dumbbell is realized. In the meanwhile, the thread pitch of the flat threaded slots is less than or equals the thread pitch of the diagonal threaded slots, so that the driven disc can be completely separated from the attachments of the dumbbell.

(3) For the dumbbell handle proposed in the embodiments of the present invention, by providing specific structures of the drive disc and the driven disc and engagement between them, during use, rotation of the planetary gear mechanism drives the gear shaft to rotate, when the first protruding block slides along the flat threaded slots in the extendable shaft, the gear shaft drives the drive disc of the cam disc mechanism to rotate, the first crests of the drive disc leave the second troughs of the driven disc towards the second crests, and drive the driven disc to leave the drive disc and make linear motion along a direction close to the attachments of the dumbbell, until the attachment supporting pieces on the driven discs are connected with the attachments of the dumbbell, at this time, the first protruding block on the gear shaft is exactly on an end portion of the flat threaded slot in the extendable shaft (a starting portion of a diagonal threaded slot), the attachments of the dumbbell are assembled to the dumbbell handle; when to adjust the attachments to neighboring positions, the first protruding block on the gear shaft will slide along the diagonal threaded slots of the extendable shaft, the gear shaft drives the drive disc in the cam disc mechanism to rotate, the first crests on the drive disc slide from the second crests to the second troughs, under action of the flexible pieces, the driven disc makes linear movements to a direction close to the drive disc and on an opposing side from the attachments of the dumbbell, until the first crests and the first troughs of the drive disc correspond to the second troughs and the second crests of the driven disc, so that the attachment supporting pieces of the driven disc are separated from the attachments of the dumbbell.

(4) For the dumbbell handle in embodiments of the present invention, by configuration of the flexible pieces, after the driven disc can resume to the initial position after being separated from the attachments of the dumbbell.

(5) For the dumbbell handle proposed in embodiments of the present invention, by connection and engagement of the first groove and the first boss, relative rotation in between the gear shaft and the drive disc can be efficiently avoided, and synchronous rotation of the gear shaft and the drive disc can be promised. During application, the first groove comprises a strip of groove along a longitudinal direction of the gear shaft.

(6) For the dumbbell proposed in embodiments of the present invention, during use, users can assemble a plurality of weight plates flexibly on the dumbbell handle as required, in the meanwhile, the attachments of the dumbbells can be used to form the dumbbell, and it is possible to adjust quickly the number of weight plates and decide whether to include the attachments of the dumbbell.

EMBODIMENTS

Figure 1:
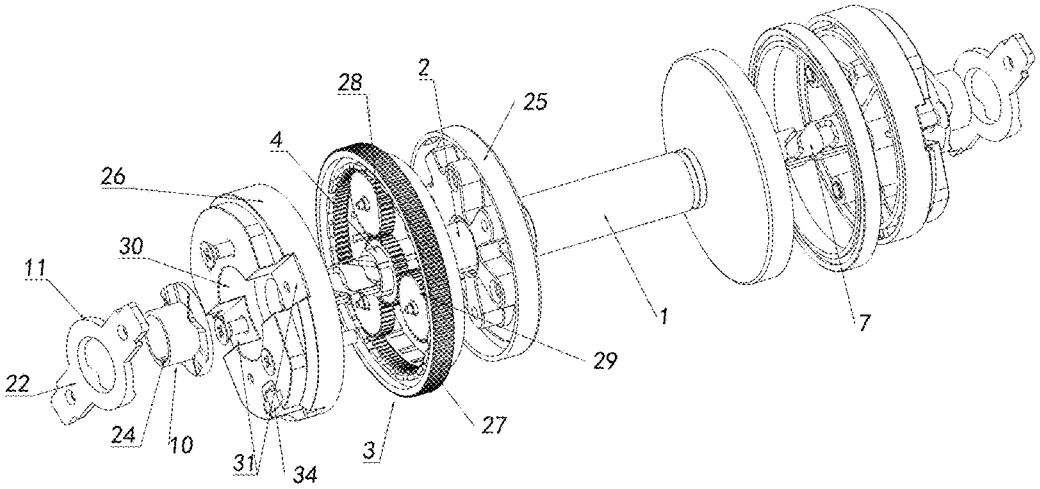
FIG. 1 is an exploded diagram showing a dumbbell handle as per an embodiment of the present invention.

To further understand the present invention, a detailed description is given to the present invention in conjunction with the drawings and the embodiments.

Hereinafter a detailed description will be given to the present invention in conjunction with the drawings and the embodiments. It shall be comprehensible that, the embodiments given here are only used to understand the present invention rather than to limit the present invention. Further, it shall be noted that, to ease description, in the drawings only those related to the present invention are shown. In the present invention, terms such as first, second, are used to make it convenient to describe the technical solutions of the present invention, and are not intended for limitation; they are general terms and shall not be construed to limit the technical solutions of the present invention. It shall be understood that, the embodiments and features in the embodiments of the present invention can be combined together. In the description of the present invention, it shall be explained that, spatial or directional relationships indicated by terms "central", "upper", "lower", "left", "right", "vertical", "horizontal", "inner" and "outer" are spatial or directional relationships as indicated in the drawings, only to ease and simplify description of the present invention, rather than indicating that the device or component must have a specific direction, or be manufactured and operated in a specific direction, therefore shall not be taken as restriction on the present invention. Furthermore, terms "first", "second", "third" are only for description, and shall not be understood to indicate or imply relative importance. Unless indicated or limited explicitly otherwise, terms "installation", "connection", "connected" shall be understand broadly, for example, connection can be fixed connection or detachable connection or integral connection; connection can be mechanical connection, electrical connection; connection can be direct connection or indirect connection via an intermediate medium, or internal communication between two parts. For those of ordinary skill in the art, the specific contents of the foregoing terms in the present invention can be understood as per specific conditions. The technical solutions in the same embodiment or the technical solutions in different embodiments can be combined or arranged to form new technical solutions without contradiction, and the new technical solutions are covered in the protection scope of the present invention.

Embodiment 1

Figure 2:
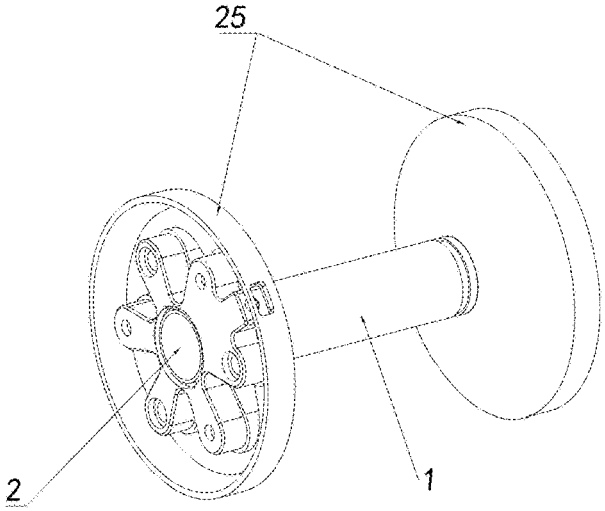
FIG. 2 is a structural diagram showing a handle body proposed in an embodiment of the present invention.

With reference to FIGS. 1-2, the present embodiment provides a dumbbell handle, comprising: a handle body 1, the handle body 1 is provided with a first cavity 2; gear rotation assemblies, wherein each of the gear rotation assemblies comprises a planetary gear mechanism 3 and a gear shaft 4, wherein the planetary gear mechanism 3 is sleeved over an end of the gear shaft 4, another end of the gear shaft 4 is sleeved in the first cavity 2 of the handle body 1; the gear shaft 4 has a second cavity 5, at least one first protruding block 6 is respectively provided at both ends of the second cavity 5 of the gear shaft 4; a extendable shaft 7, wherein the extendable shaft 7 is sleeved in the second cavity 5 of the gear shaft 4, threaded slots 8 corresponding to the at least one first protruding block 6 are provided in the extendable shaft 7, by rotating the planetary gear mechanism 3 the gear shaft 4 is driven to rotate, and further the extendable shaft 7 is driven to move axially in the second cavity 5 of the gear shaft 4; at least one cam disc mechanism, comprising at least one drive disc 10 and at least one driven disc 11, wherein the at least one drive disc 10 engages with the at least one driven disc 11 by sliding, at least one flexible piece 21 is provided at a side of the at least one driven disc 11 on an opposing side from the drive disc 10, the at least one drive disc 10 is sleeved over an end portion of the gear shaft 4, the at least one drive disc 10 is driven to rotate by the gear shaft 4, and drives the at least one driven disc 11 to make reciprocating linear movement along an axial direction of the gear shaft 4.

In the present embodiment, a weight of attachments of the dumbbell is usually a half of the weight of weight plates 35, the at least one driven disc 11 is configured to be connected with the attachments 12 of the dumbbell, the planetary gear mechanism 3 comprises a ring gear 27, a sun gear 28 and three planet gears 29, and is applied in the dumbbell handle. During use, by rotating the planetary gear mechanisms 3 to drive the gear shaft 4 to rotate, as at least one first protruding block 6 is provided on both ends of the second cavity 5 of the gear shaft 4, threaded slots 8 corresponding to the at least one first protruding block 6 are provided in the extendable shaft 7, the gear shaft 4 rotates and drives the extendable shaft 7 to move axially in the second cavity 5 of the gear shaft 4, that is, extension and retraction of the extendable shaft 7 in the second cavity 5; as the at least one drive disc 10 is sleeved over the gear shaft 4, the flexible piece 21 is provided at a side of the at least one driven disc 11 away from the at least one drive disc 10, the at least one drive disc 10 is driven to rotate by the gear shaft 4, and drives the at least one driven disc 11 to make reciprocating linear movements along an axial direction of the gear shaft 4, so as to connect or separate the at least one driven disc 11 and the attachments 12 of the dumbbell. For the foregoing dumbbell handle, by using the planetary gear mechanism 3 (comprising a ring gear 27, a sun gear 28 and three planet gears 29), and taking use of the multiple relationship between the number of teeth of the ring gear 27 and the number of teeth of the sun gear 28, the extendable shaft 7 in the dumbbell handle can be adjusted by a smaller thread pitch, quick extension and retraction of the extendable shaft 7 in the dumbbell handle can be done accurately, so as to realize fast adjustment of the number of weight plates, that is, adjustment of the weight options of the dumbbell; in the meanwhile, by cooperation relationships of the cam disc mechanisms, the flexible pieces 21 and the gear shafts 4 and the gear shafts 4 and the extendable shafts 7, the extendable shafts 7 can be retractable in the dumbbell handle (to adjust the weight options of the dumbbell), connection and separation of the at least one driven disc 11 and the attachments 12 of the dumbbell can be realized, assembly and detachment of the attachments 12 of the dumbbell can be realized, compared with conventional adjustable dumbbells, without requiring rotating the dumbbell handle 1, assembly and detachment of the attachments 12 of the dumbbell can be realized, the number of adjustable weight options is increased and the problem that due to the fact that the weight adjusted by changing the weight options is too big and goes beyond the weight that users can afford to increase and exercise effects are influenced, especially for women who are weak in strength can be overcome.

Embodiment 2

Figure 5:
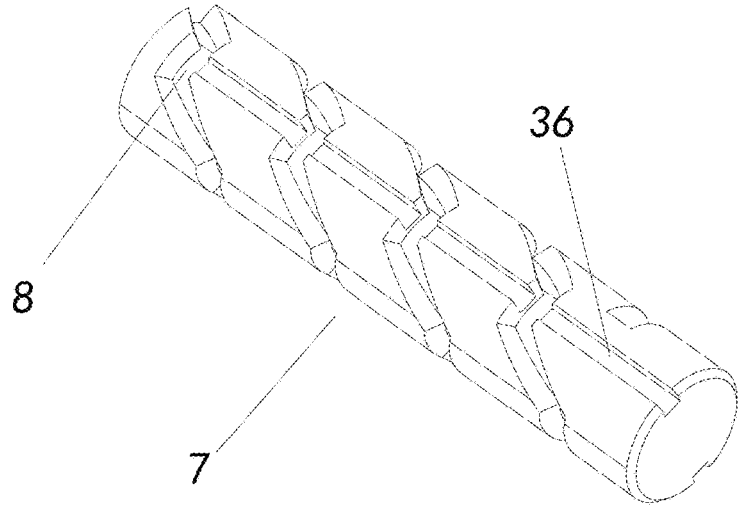
FIG. 5 is a structural diagram of a extendable shaft according to an embodiment of the present invention.
Figure 6:
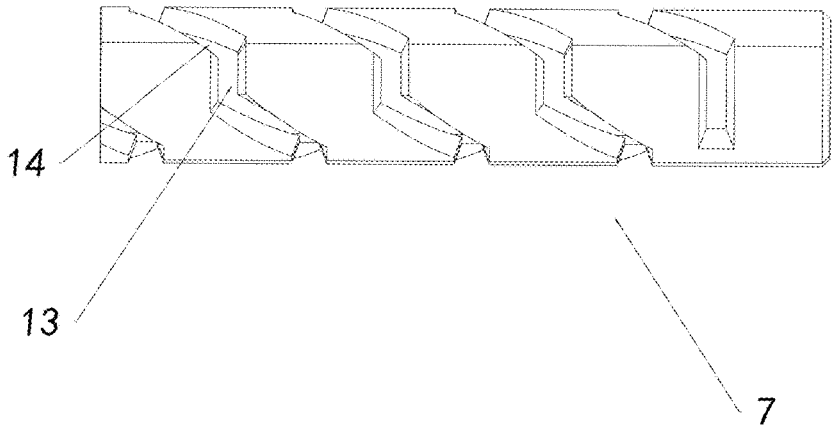
FIG. 6 is a front view of the extendable shaft according to an embodiment of the present invention.

With reference to FIGS. 5-6, for the dumbbell handle in the present embodiment, compared with the technical solutions in the embodiment 1, what is improved is that: the threaded slots 8 comprise alternately provided flat threaded slots 13 and diagonal threaded slots 14, a thread pitch of the flat threaded slots 13 is smaller than or equals a thread pitch of the diagonal threaded slots 14.

In the present embodiment, by rotation of the planetary gear mechanism 3, the gear shaft 4 is driven to rotate, the at least one first protruding block 6 on the gear shaft 4 slides in the flat threaded slots 13, the gear shaft 4 drives the at least one drive disc 10 of the cam disc mechanism to rotate, the at least one drive disc 10 slides against the at least one driven disc 11, the at least one driven disc 11 makes reciprocating linear movement along a direction away from the at least one drive disc 10 and close to the attachment 12 of the dumbbell, until the at least one driven disc 11 is connected with the attachment 12 of the dumbbell, when adjusting to a neighboring weight option, the at least one first protruding block 6 of the gear shaft 4 transits from the flat threaded slots in the extendable shaft 7 to the diagonal threaded slots 14 in the extendable shaft 7, the gear shaft 4 drives the at least one drive disc 10 of the cam disc mechanism to rotate, so as to have the at least one driven disc 11 to make linear movement in a direction close to the at least one drive disc 10 and on an opposing side from the attachment 12 of the dumbbell, the at least one driven disc 11 is separated from the attachment 12 of the dumbbell. When the at least one first protruding block 6 slides in the flat threaded slots in the extendable shaft 7, the extendable shaft 7 does not extend or retract in the second cavity 5, therefore, when the first protruding block 6 transits between sliding into the diagonal threaded slots 14 to sliding out of the diagonal threaded slots 14, correspondingly, a length that the extendable shaft 7 extends or retracts is exactly a thickness of a piece of weight plate. In this way, the weight plates 35 can be accurately adjusted as the length that the extendable shaft 7 extends or retracts every time corresponds to an axial length of the diagonal threaded slots.

Therefore, in the present embodiment, by controlling the at least one first protruding block 6 to engage alternately with the flat threaded slots 13 and the diagonal threaded slots 14 in the extendable shaft 7, quick assembly and detachment of the attachments of the dumbbell can be done. In the meanwhile, as the thread pitch of the flat threaded slots 13 is smaller than or equals the thread pitch of the diagonal threaded slots 14, by such configuration complete separation of the at least one driven disc 11 and the attachments 12 of the dumbbell can be efficiently promised. During application, the flat threaded slots 13 extend circumferentially along the extendable shaft 7 and are perpendicular to an extension direction of the extendable shaft, and by such configuration, when the at least one first protruding block 6 slides against the flat threaded slots 13 the extendable shaft 7 does not move only the at least one drive disc 10 is driven to move. In another special embodiment, all the flat threaded slots can be parallel to each other and are parallel to end surfaces of the extendable shaft.

Embodiment 3

Figure 3:
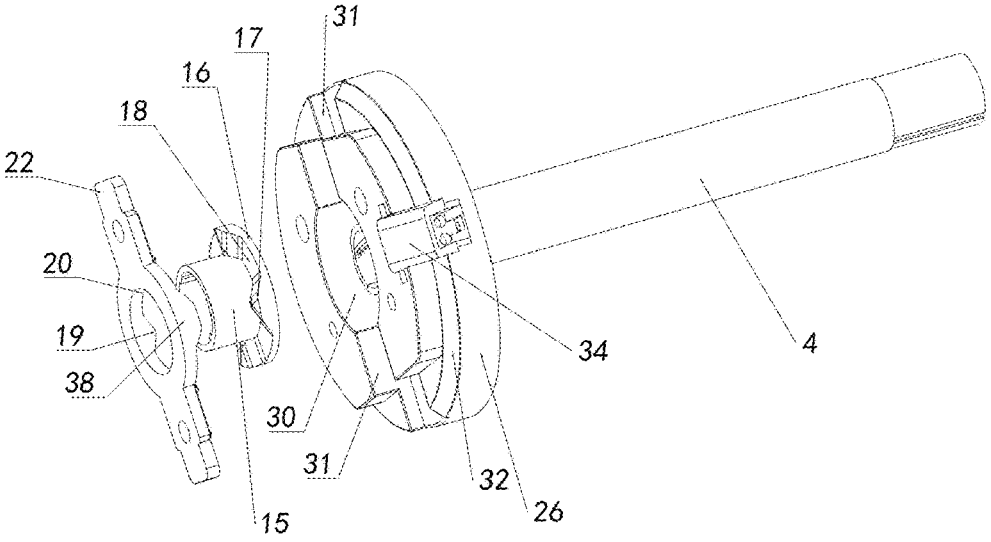
FIG. 3 is a locally exploded diagram showing the dumbbell handle as per an embodiment of the present invention.

With reference to FIG. 3, for the dumbbell handle in the present embodiment, compared with the technical solution in embodiment 2, the improvements are that: the at least one drive disc 10 is provided with a first hollow pillar 15, one end of the first hollow pillar 15 is provided with a ring boss 16, first crests 17 and first troughs 18 are circumferentially provided around the ring boss 16, the at least one driven disc 11 is provided with a second hollow pillar 38, the second hollow pillar 38 is sleeved over the first hollow pillar 15, attachment supporting pieces 22 are provided on the second hollow pillar 38, second crests 19 and second troughs 20 are provided circumferentially on an end portion of the second hollow pillar 38 close to the ring boss 16, the first crests 17 are provided corresponding to the second troughs 20 and the first troughs 18 are provided corresponding to the second crests 20.

In the present embodiment, the first crests 17 and the second crests 19 are the same in size and shape, the first troughs 18 and the second troughs 20 are the same in size and shape, an angle between neighboring first crests 17 is bigger than or equals an angle that the at least one drive disc 10 is rotated for adjusting to a next weight option, at the initial position, the first crests 17 are provided corresponding to the second troughs 20, and the first troughs 18 are provided corresponding to the second crests 19. During use, rotating the planetary gear mechanism 3 to drive the gear shaft 4 to rotate, the at least one first protruding block 6 on the gear shaft 4 slides in the flat threaded slots 13 in the extendable shaft 7, the gear shaft 4 drives the at least one drive disc 10 of the cam disc mechanism to rotate, the first crests 17 of the at least one drive disc 10 leave the second troughs 20 of the at least one driven disc 11 to the second crests 19, and drive the at least one driven disc 11 to make linear movement to a direction away from the at least one drive disc 10 and close to the attachment 12 of the dumbbell, until the attachment supporting pieces 22 of the at least one driven disc 11 are connected with the attachment 12 of the dumbbell, at this time, the at least one first protruding block 6 on the gear shaft 4 is exactly at ends of the flat threaded slots 13 of the extendable shaft 7 (starting portions of the diagonal threaded slots), the attachment 12 of the dumbbell is assembled to the dumbbell handle; when adjusting to the next weight option, the at least one first protruding block 6 will slide in the diagonal threaded slots 14 in the extendable shaft 7, the gear shaft 4 drives the at least one drive disc 10 of the cam disc mechanism to rotate, the first crests 17 of the at least one drive disc 10 will slide from the second crests 19 of the at least one driven disc 10 to the second troughs 20, under action of the flexible pieces, the at least one drive disc 11 will make linear movements to a direction close to the at least one drive disc 10 and on an opposing side from the attachment 12 of the dumbbell, until the first crests 17 and the first troughs 18 of the at least one drive disc 10 correspond respectively to the second troughs 20 and the second crests 19 of the at least one driven disc 11 so that the attachment supporting pieces 22 on the at least one driven disc 11 will be completely separated from the attachment 12 of the dumbbell.

Embodiment 4

With reference to FIG. 1, for the dumbbell handle in the present embodiment, compared with embodiment 3, the improvements are as following: the flexible pieces 21 are provided respectively beside the attachment supporting pieces 22. By such configuration, the at least one driven disc 11 will resume to the initial position after being separated from the attachments 12 of the dumbbell. During application, the flexible pieces 21 comprise springs, and the springs are provided in between the first weight plate close to the dumbbell handle and the at least one driven disc.

Embodiment 5

With reference to FIGS. 1-4, for the dumbbell handle in the present embodiment, compared with the technical solutions in embodiment 4, the improvements are that: first grooves 23 are provided in the gear shaft 4, positions of the first grooves 23 are corresponding to positions of the at least one first protruding block 6, and first bulges 24 meshing with the first grooves 23 are provided in the at least one drive disc 10. By engagement of the first grooves 23 and the first bulges 24, relative rotation in between the gear shaft 4 and the at least one drive disc 10 can be effectively avoided, and synchronous rotation of the at least one gear shaft 4 and the at least one drive disc 10 can be promised. During use, the first grooves 23 comprise strip-shaped grooves along a longitudinal direction of the gear shaft.

Embodiment 6

Figure 4:
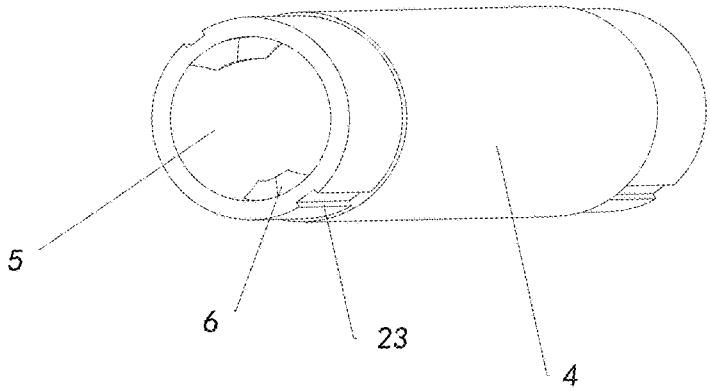
FIG. 4 is a structural diagram showing a gear shaft according to an embodiment of the present invention.

With reference to FIG. 4, for the dumbbell handle in the present embodiment, compared with the technical solution of the present embodiment, the improvements are as following: the dumbbell handle further comprises at least one first flange 25 and at least one second flange 26, the at least one first flange 25 is provided at both ends of the dumbbell handle 1, the first flange 25 at an end of the dumbbell handle 1 is connected rotatably with the planetary gear mechanism 3; the planetary gear mechanism 3 comprises a ring gear 27, a sun gear 28 and three planet gears 29, the ring gear 27 and the sun gear 28 engage with the planet gears 29; the cam disc mechanism is provided on the at least one second flange 26, the at least one second flange 26 engages with the ring gear 27 by clearance fit, and the at least one first flange 25, the planetary gear mechanism 3 and the at least one second flange 26 are fixed via threaded rods. By providing the at least one first flange 25, the connection firmness of the planetary gear mechanism 3 on the dumbbell handle can be enhanced; by providing the at least one second flange 26, the connection firmness of the cam disc mechanism on the dumbbell handle can be further improved, in the meanwhile, by connecting integrally the at least one first flange 25, the planetary gear mechanism 3 and the at least one second flange 26, the overall stability of the dumbbell handle can be improved.

During actual application, as shown in FIG. 3, at least one second groove 26 is provided in a side of the at least one second flange 26 far from the at least one first flange 25, at least one through-hole is provided in the at least one second groove 30, the at least one through-hole is configured for passing the gear shaft 4, the at least one drive disc 10 is sleeved in the at least one second groove 30, at least one first notch 31 is provided in the at least one second groove 30, the attachment supporting pieces 22 of the at least one driven disc 11 engage with the at least one first notch 31 axially by sliding, second notches 32 are provided circumferentially along the at least one second flange 26, and the second notches 32 are configured to be connected with the attachment 12 of the dumbbell. During actual use, the attachment 12 of the dumbbell comprises a U-shaped ring, and the second notches 32 on the second flange 26 comprise ring notches.

During application, as shown in FIG. 1, during assembling the dumbbell handle, first of all, installing the planetary gear mechanism 3 into the first cavity 2 in the dumbbell handle body 1 via the gear shaft 4, the planetary gear mechanism 3 and the first cavity 2 are in clearance fit, thereafter, installing the connection pin assembly and the second flange 26 of the cam disc mechanism, fixing the second flange 26 to the first flange 25 at an end of the handle body 1 via the threaded rods in the three planet gears 29, similarly, installing a decoration ring and the second flange 26 at another end of the handle body 1; finally installing the extendable shaft 7, and the extendable shaft 7 cooperates with the gear shaft 4 via threaded to form an adjustable dumbbell handle. By such configuration, installing the decoration ring at another end of the dumbbell handle is to be symmetric to the ring gear at another end of the dumbbell handle. In the meanwhile, the planetary gear mechanism 3 can be firmly connected to the handle body 1 under cooperation of the first flange 25 and the second flange 26.

Embodiment 7

With reference to FIGS. 1 and 3, for the dumbbell handle in the present embodiment, compared with the technical solutions in embodiment 6, the improvements are that: the dumbbell handle further comprises at least one connection pin assembly, a connection slot 34 is provided in a side of the second flange 26 on an opposing side from the gear mechanism, the at least one connection pin assembly is provided slidably in the connection slot 34, so that the connection pin assembly can be used for connecting the ring gear 27 and the extendable shaft 7. When an external force acts on the connection pin assembly, the connection pin assembly moves in the connection slot 34, the connection pin assembly is thus separated from the ring gear 27, the ring gear 27 rotates and drives the extendable shaft 7 to stretch or retract; when the external force on the connection pin assembly is removed, under action of the flexible pieces, the connection pin assembly is resumed to the original position and locks again the ring gear 27 and the extendable shaft 7.

Embodiment 8

Figure 8:
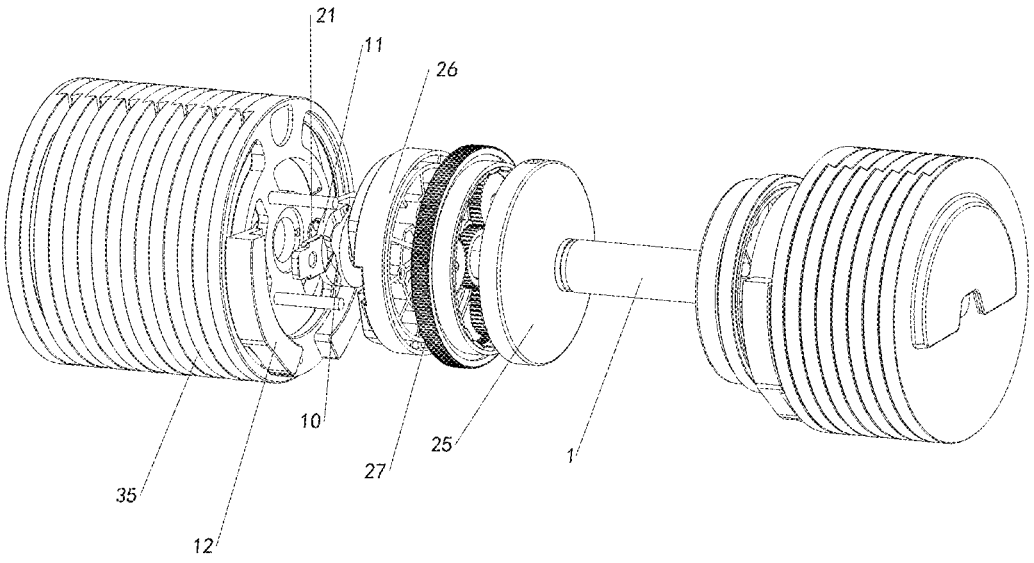
FIG. 8 is an exploded diagram showing the dumbbell with attachments according to another embodiment of the present invention.

With reference to FIG. 8, the present embodiment provides a dumbbell, comprising the dumbbell handle defined in any of embodiments 1-7, and the attachments 12 and a plurality of weight plates 35 are provided at both ends of the dumbbell handle, and the attachments 12 of the dumbbell are provided in between the first weight plates 35 and the cam disc mechanisms.

During actual application, positioning bulges are provided at the first weight plates 35 close to the dumbbell handle, third grooves 36 are provided in the extendable shaft along a longitudinal direction of the extendable shaft, the positioning bulges engage with the third grooves 36 to prevent the extendable shaft from rotating.

Embodiment 9

Figure 7:
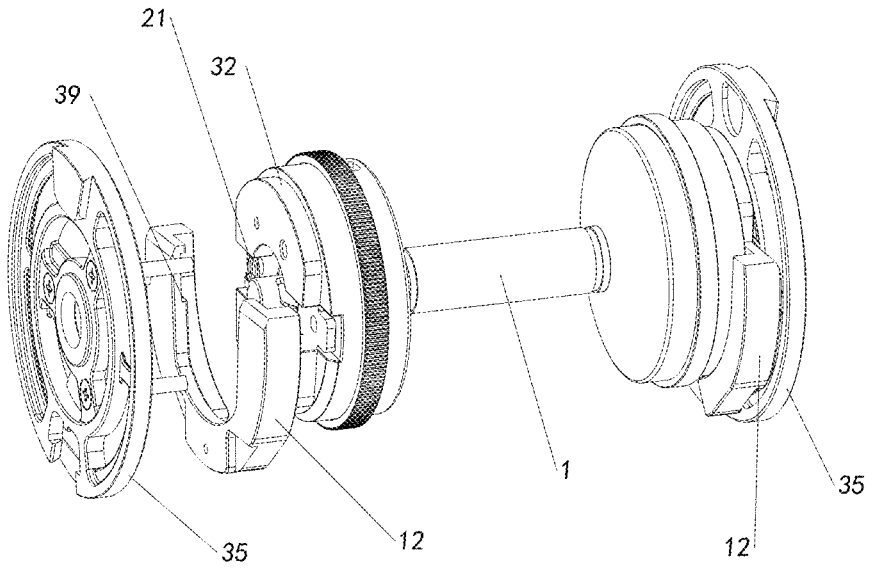
FIG. 7 is an exploded diagram showing the dumbbell with attachments according to an embodiment of the present invention.

With reference to FIG. 7, for the dumbbell in the present embodiment, compared with the technical solution in embodiment 8, the improvements are that: supporting slots 39 for connecting with the at least one driven disc axially are provided in the attachments 12 of the dumbbell. During application, the supporting slots 39 in the attachments 12 of the dumbbell are connected with the attachment supporting pieces 22 of the at least one driven disc 11 axially. The attachment supporting pieces 22 comprise supporting plates, the supporting grooves 39 are connected with the supporting plates to connect the attachments 12 of the dumbbell and the at least one driven disc 11. During use, users can assemble a plurality of weight plates 35 on the dumbbell handle as required, in the meanwhile, the attachments 12 of the dumbbell can be used to form a dumbbell, and it is possible to quickly adjust the number of the weight plates 35 and the attachments 12 of the dumbbell.

Embodiment 10

Figure 9:
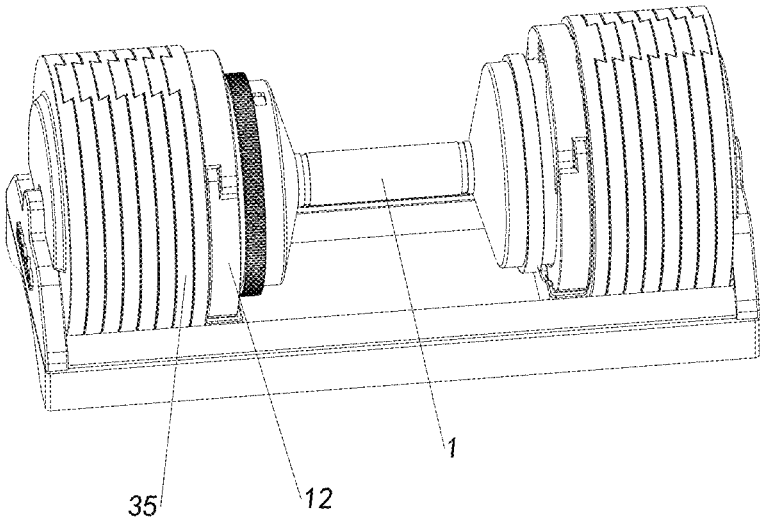
FIG. 9 is a structural diagram showing the dumbbell with attachments placed on a dumbbell base according to an embodiment of the present invention.

With reference to FIG. 9, the present embodiment provides a dumbbell base, the dumbbell base is configured to place the dumbbell as defined in the technical solutions of embodiment 8 or 9, the dumbbell base is provided with a supporting assembly, the supporting assembly is configured to be engaged with the dumbbell handle defined in technical solutions of any of embodiments 1-7 for adjusting the length of the dumbbell handle.

During application, the supporting assembly comprises at least one second protruding block, and a dimension of the second protruding block is reduced gradually along with a reduction of distance to the connection pin assembly. A dimension of the second protruding block in an upper portion is smaller than a dimension of the connection slots 34, and the dimension of the second protruding block is gradually decreased along with a reduction in distance to the connection pin assembly. A cross section of the second protruding block is a trapezoid. By such configuration, the supporting assembly can support to a better extent the connection pin assembly. Specifically, when the assembled dumbbell is placed on the dumbbell support of the dumbbell base, the supporting assembly will support the connection pin assembly, so that the connection pin assembly is separated from the ring gear 27, rotating the ring gear 27, the gear shaft 4 will rotate correspondingly, and drive the extendable shaft 7 to stretch or retract, so as to realize quick adjustment of the weight plates 35 and the installation and disconnection of the attachments 12 of the dumbbell 12.

In the foregoing paragraphs, a description is given to the present invention and embodiments thereof, the description is not restrictive, those shown in the drawings are some of the embodiments of the present invention, and the actual structures are not limited thereto. Therefore, all structural improvements and embodiments similar to the technical solutions of the present invention made by those of ordinary skill in the art without involving creative effort and departing from the essence of the present invention shall fall into the protection scope of the present invention.

The invention claimed is:

1. A dumbbell handle, comprising:

a handle body, wherein a first cavity is provided in the handle body;

a gear rotation assembly, wherein the gear rotation assembly comprises a planetary gear mechanism and a gear shaft, the planetary gear mechanism is sleeved over an end of the gear shaft, another end of the gear shaft is sleeved in the first cavity of the handle body; the gear shaft is provided with a second cavity, at least one first protruding block is respectively provided on both ends of the second cavity of the gear shaft;

at least one extendable shaft, wherein the at least one extendable shaft is sleeved in the second cavity in the gear shaft, at least one threaded slot engaging with the at least one first protruding block is provided in the at least one extendable shaft, by rotating the planetary gear mechanism the gear shaft is driven to rotate and the at least one shaft is driven to move axially in the second cavity of the gear shaft;

at least one cam disc mechanism, wherein the at least one cam disc mechanism respectively comprises a drive disc and a driven disc, the drive disc and the driven disc are engaged by sliding, a flexible piece is provided at a side of the driven disc on an opposing side from the drive disc, the drive disc is sleeved over an end of the gear shaft, the drive disc is driven to rotate by the gear shaft and drives the driven disc to make reciprocating linear movement.

2. The dumbbell handle according to claim 1, wherein the threaded slots comprise alternately connected flat threaded slots and diagonal threaded slots, and a thread pitch of the flat threaded slots is smaller than or equals a thread pitch of the diagonal threaded slots.

3. The dumbbell handle according to claim 2, wherein the drive disc is provided with a hollow pillar that is sleeved over the end of the gear shaft, an end of the hollow pillar is provided with a ring boss, first crests and first troughs are provided intermittently and circumferentially along the ring boss, the driven disc is provided with a second hollow pillar, and the second hollow pillar is sleeved over the first hollow pillar, an attachment supporting piece is provided outside the second hollow pillar, second crests and second troughs are provided intermittently and circumferentially on an end of the second hollow pillar close to the ring boss, the first crests and the second troughs are provided, and the first troughs and the second crests are provided.

4. The dumbbell handle according to claim 3, wherein the flexible piece is provided beside the attachment supporting piece.

5. The dumbbell handle according to claim 1, wherein at least one first groove is provided in the gear shaft, a position of the at least one first groove is provided corresponding to the at least one first protruding block, and at least one first bulge meshing with the at least one first groove is corresponding provided on the drive disc.

6. The dumbbell handle according to claim 1, further comprising at least one first flange and at least one second flange, both ends of the dumbbell handle are provided with the at least one first flange, the at least one first flange at an end of the handle body is connected rotatably with the planetary gear mechanism; the planetary gear mechanism comprises a ring gear, a sun gear and three planet gears, the ring gear and the sun gear engage with the planet gears; the at least one cam disc mechanism is provided on the second flange, the second flange engages with the ring gear by clearance fit, and the at least one first flanges, the planetary gear mechanism and the at least one second flange are fixed by threaded rods.

7. The dumbbell handle according to claim 1, further comprising a connection pin assembly, wherein a connection groove is provided along an edge of the at least one second flange on an opposing side from the gear mechanism, the connection pin assembly is slidably provided in the connection groove, so as to connect the ring gear and the at least one extendable shaft.

8. A dumbbell, wherein the dumbbell comprises the dumbbell handle as defined in any of claims 1-7, attachments of the dumbbell and weight plates are evenly provided at both ends of the dumbbell handle, and the attachments of the dumbbell are provided in between first weight plates close to the dumbbell handle and the at least one cam disc mechanism.

9. The dumbbell according to claim 8, wherein supporting grooves for connection and engagement with the at least one driven disc are provided in the attachments of the dumbbell.

* * * * *